US010662914B2

(12) United States Patent
Nagaoka et al.

(10) Patent No.: US 10,662,914 B2
(45) Date of Patent: May 26, 2020

(54) FUEL INJECTION VALVE

(71) Applicant: HITACHI AUTOMOTIVE SYSTEMS, LTD., Hitachinaka-shi, Ibaraki (JP)

(72) Inventors: Masaki Nagaoka, Maebashi (JP); Nobuaki Kobayashi, Maebashi (JP); Ryuta Kinoshita, Mito (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days.

(21) Appl. No.: 15/554,045

(22) PCT Filed: Feb. 5, 2016

(86) PCT No.: PCT/JP2016/053504
§ 371 (c)(1),
(2) Date: Aug. 28, 2017

(87) PCT Pub. No.: WO2016/143434
PCT Pub. Date: Sep. 15, 2016

(65) Prior Publication Data

US 2018/0066620 A1 Mar. 8, 2018

(30) Foreign Application Priority Data

Mar. 11, 2015 (JP) ..... 2015-047890

(51) Int. Cl.
*F02M 61/16* (2006.01)
*F02M 61/18* (2006.01)
(Continued)

(52) U.S. Cl.
CPC ..... *F02M 61/1806* (2013.01); *F02M 51/06* (2013.01); *F02M 51/061* (2013.01);
(Continued)

(58) Field of Classification Search
CPC ..... F02M 61/162; F02M 61/1806; F02M 61/1853; F02M 61/186; F02M 61/1846; F02M 61/1873
(Continued)

(56) References Cited

U.S. PATENT DOCUMENTS 4,945,877 A * 8/1990 Ziegler ..... F02M 51/061 123/472
6,170,763 B1 1/2001 Fuchs et al.
(Continued)

FOREIGN PATENT DOCUMENTS

DE 10 2012 213 086 A1 1/2013
EP 2 690 277 A1 1/2014
(Continued)

*Primary Examiner* — Alex M Valvis
(74) *Attorney, Agent, or Firm* — Foley & Lardner LLP

(57) ABSTRACT

Disclosed is a fuel injection valve comprising: a fuel injection orifice provided in a downstream side of a valve seat which a valve body moves toward and away from; a swirl chamber having a swirl passage formed around the entry opening of the fuel injection orifice; and a transverse passage whose end is opened in an inner circumferential wall of the swirl chamber in order to provide a fuel into the swirl chamber, wherein a center of the entry opening is shifted from a first position where the velocity component in the swirl direction of the fuel can be maximized to a second position where the velocity component in the swirl direction is reduced, and where a velocity component in a center axis direction of the fuel injection orifice is enhanced. Thereby, it is possible to easily adjust a fuel injection amount and a spray angle.

6 Claims, 11 Drawing Sheets

(51) Int. Cl.
*F02M 51/06* (2006.01)
*F02M 63/00* (2006.01)

(52) U.S. Cl.
CPC ..... *F02M 61/162* (2013.01); *F02M 61/18* (2013.01); *F02M 61/1853* (2013.01); *F02M 63/0031* (2013.01)

(58) Field of Classification Search
USPC ..... 239/463, 468, 494, 497, 533.12
See application file for complete search history.

(56) References Cited

U.S. PATENT DOCUMENTS 6,405,945 B1 * 6/2002 Dobrin ..... F02M 51/061 239/463
6,854,670 B2 * 2/2005 Sumisha ..... F02M 51/0678 239/468
8,882,003 B2 11/2014 Okamoto et al.
9,157,403 B2 * 10/2015 Saito ..... F02M 61/162
2003/0141385 A1 * 7/2003 Xu ..... F02M 61/162 239/463
2004/0217204 A1 * 11/2004 Sugimoto ..... F02M 61/162 239/494
2012/0193566 A1 8/2012 Yasukawa et al.
2014/0251262 A1 * 9/2014 Okamoto ..... F02M 61/162 123/306
2014/0251264 A1 * 9/2014 Okamoto ..... F02M 63/0078 123/306

FOREIGN PATENT DOCUMENTS

JP H07-035001 A 2/1995
JP 2000-508739 A 7/2000
JP 2003-336562 A 11/2003
JP 2004-340121 A 12/2004
JP 2006-029131 A 2/2006
JP 2012-158995 A 8/2012
JP 2014-031758 A 2/2014

* cited by examiner

FUEL INJECTION VALVE

TECHNICAL FIELD

The present invention relates to a fuel injection valve that generates swirl fuel at an upstream side of a fuel injection orifice and injects the swirl fuel from the fuel injection orifice.

BACKGROUND ART

As a background art of the technical field relating to the present invention, a fuel injection valve disclosed in Japanese Patent Provisional Publication No. 2003-336562 (Patent Document 1) is known. This fuel injection valve has a valve seat member; a transverse passage that communicates with a downstream end of the valve seat; and a swirl chamber in which a downstream end of the transverse passage opens in a tangential direction. Furthermore, the transverse passage and the swirl chamber are provided between the valve seat member and an injector plate coupled to a front end surface of the valve seat member. The injector plate has each of fuel injection orifices which jets fuel having gotten a swirl in the swirl chamber. In the fuel injection valve, the fuel injection orifice is offset by a predetermined distance from a center of the swirl chamber toward an upstream end side of the transverse passage (see abstract). With this structure, atomization of the injected fuel is promoted, and a fuel injection response is improved.

However, in the fuel injection valve for jetting a fuel wherein the transverse passage, the swirl chamber, and the fuel injection orifice are formed on the injector plate, generally a spray angle is set by adjusting a diameter and length of the fuel injection orifice and a size (diameter) of the swirl chamber. If any one of the diameter and length of the fuel injection orifice or the size (diameter) of the swirl chamber is changed in order to adjust the spry angle, an amount of fuel jetted from the fuel injection orifice (fuel injection amount) is changed. Therefore, a long times have been spent on determining the diameter and length of the fuel injection orifice and the size (diameter) of the swirl chamber so that both of the fuel injection amount and the spray angle are kept within the predetermined range.

PRIOR ART DOCUMENT

Patent Document

Patent Document 1: Japanese Patent Provisional Publication No. 2003-336562

SUMMARY OF THE INVENTION

It is an object of the present invention to provide a fuel injection valve in which a fuel injection amount and a spray angle can be adjusted easily.

In order to achieve the above object, according to one aspect of the present invention, a fuel injection valve comprises:

a valve body;

a fuel injection orifice provided in a downstream side of a valve seat which the valve body moves toward and away from;

a swirl chamber having a bottom surface on which an entry opening of the fuel injection orifice opens and an inner circumferential wall surrounding the bottom surface, the swirl chamber having:

a swirl passage for a fuel, the swirl passage formed between the inner circumferential wall and the entry opening; and a transverse passage whose downstream end is opened in the inner circumferential wall of the swirl chamber in order to provide the fuel into the swirl chamber, the transverse passage having:

one width direction end part connected to an upstream side of the inner circumferential wall in a flow direction of a swirl fuel; and the other width direction end part connected to a downstream side of the inner circumferential wall in the flow direction of the swirl fuel, and when imaging an extension line formed by extending the other width direction end part of the transverse passage to a swirl chamber side, and a straight line segment passing a center of the swirl chamber and being perpendicular to the extension line, a center of the entry opening of the fuel injection orifice being positioned to be shifted from the center of the swirl chamber along the extension line, and in two areas formed by dividing the swirl chamber into two with the straight line segment, the center of the entry opening of the fuel injection orifice being arranged in an area opposite to an area to which the transverse passage is connected.

According to another aspect of the invention, a fuel injection valve comprises:

a valve body;

a fuel injection orifice provided in a downstream side of a valve seat which the valve body moves toward and away from;

a swirl chamber having an entry opening of the fuel injection orifice and a swirl passage for a fuel, the swirl passage formed around the entry opening;

a transverse passage to provide the fuel into the swirl chamber; and a nozzle plate on which the fuel injection orifice, the swirl chamber, and the transverse passage are formed, wherein:

in flow passage width which is formed in both side of the entry opening on a line segment passing a center of the entry opening of the fuel injection orifice and a center of the nozzle plate, the flow passage width in the upstream side in the flow direction of the swirl fuel is smaller than the flow passage width in the downstream side in the flow direction of the swirl fuel.

Furthermore, according to another aspect of the invention, a fuel injection valve comprises:

a valve body;

a fuel injection orifice provided in a downstream side of a valve seat which the valve body moves toward and away from;

a swirl chamber having an entry opening of the fuel injection orifice and a swirl passage for a fuel, the swirl passage formed around the entry opening; and a transverse passage to provide the fuel into the swirl chamber, wherein:

a center of the entry opening of the fuel injection orifice is arranged to be shifted from a first position to a second position, the first position being a position where a velocity component in a swirl direction of a fuel flowing into the fuel injection orifice is max, the second position being a position where the velocity component in the swirl direction gets small and where a velocity component in a center axis direction of the fuel injection orifice gets large.

According to the present invention, it is possible to largely change the spray angle while reducing a change rate of the fuel injection amount. Therefore, it is possible to provide a fuel injection valve being capable of providing a desired fuel injection amount and spray angle by easily adjusting the fuel injection amount and the spray angle. Thereby, design or design change of the fuel injection valve is simplified.

DESCRIPTION OF THE EMBODIMENTS

An embodiment of the present invention will be explained below with reference to FIGS. 1 to 8.

Figure 1:
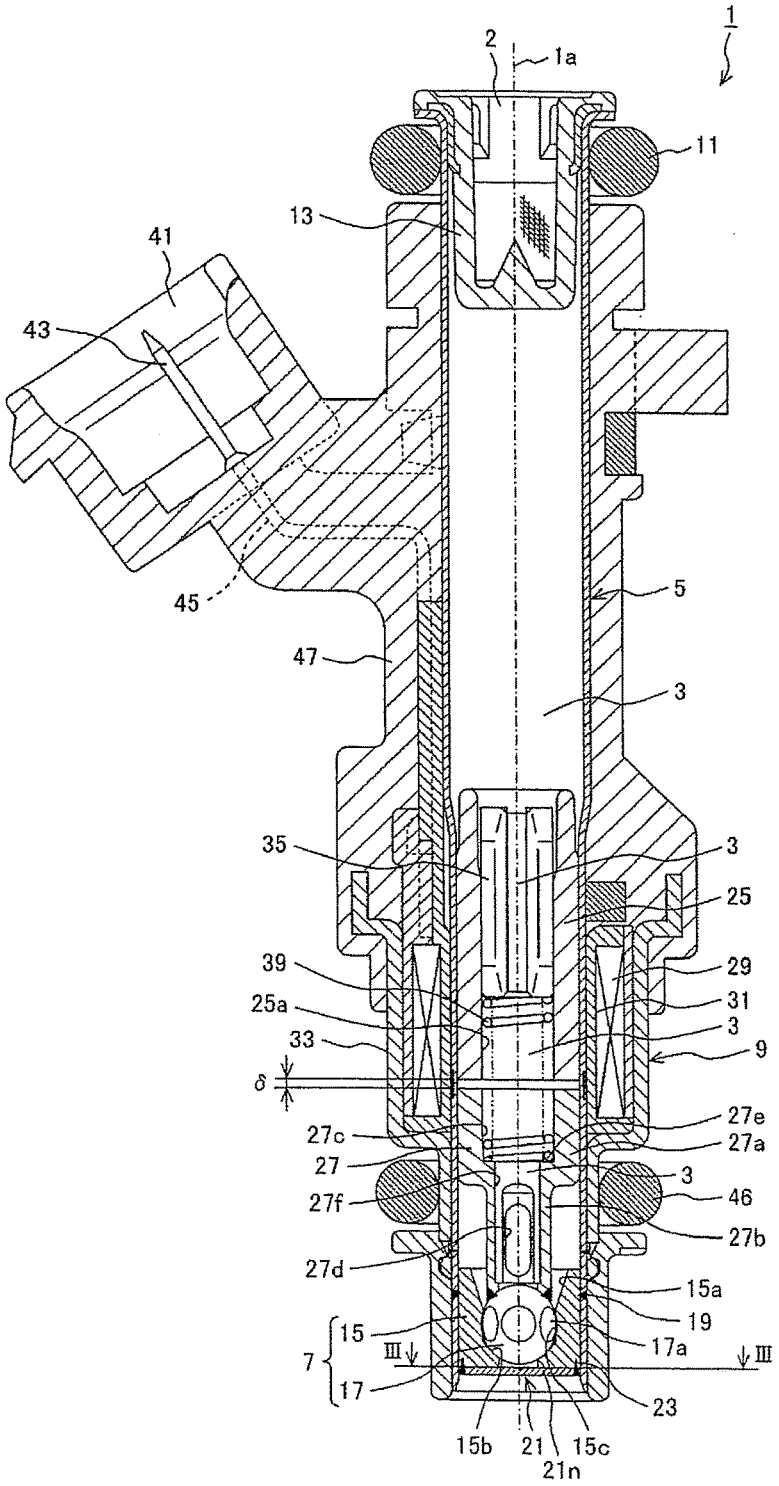
FIG. 1 is a longitudinal section drawing showing a cross section taken along a valve axis (a center axis line) of the fuel injection valve, according to the present invention.

A whole configuration of a fuel injection valve 1 will be explained using FIG. 1. FIG. 1 is a longitudinal section drawing showing a cross section taken along a center axis line 1*a* of the fuel injection valve 1, according to the present embodiment. The center axis line 1*a* coincides with an axis (valve axis) of a movable element 27 to which an after-mentioned valve body 17 is integrally fixed. The center axis line 1*a* also coincides with a center axis line of an after-mentioned cylindrical body 5, and further coincides with each center line of an after-mentioned valve seat 15*b* and a nozzle plate 21*n*.

The fuel injection valve 1 is provided with the metal-made cylindrical body 5 extending from an upper end portion to a lower end portion of the fuel injection valve 1. A fuel flow passage 3 is formed inside the cylindrical body 5 so as to extend substantially along the center axis line 1*a*. In FIG. 1, the upper end portion (an upper end side) is called a base end portion (a base end side), and the lower end portion (a lower end side) is called a top end portion (a top end side). These terms "base end portion (base end side)" and "top end portion (top end side)" are based on a flow direction of fuel or a fixing structure to a fuel pipe (not shown). That is, the base end portion is an upstream side in the fuel flow direction, and the top end portion is a downstream side in the fuel flow direction. Furthermore, in the present description, for convenience of explanation, upper and lower positions of each element or component are defined based on FIG. 1, and these upper and lower positions have nothing to do with up and down directions in a mounting state of the fuel injection valve 1 in an internal combustion engine.

The cylindrical body 5 is provided, at a base end portion thereof, with a fuel supply port 2. A fuel filter 13 is fixed to the fuel supply port 2. The fuel filter 13 is a member to filter out foreign particles included in the fuel.

The cylindrical body 5 is further provided, at the base end portion thereof, with an O-ring 11. The O-ring 11 functions as a sealing member when the fuel injection valve 1 is connected to the fuel pipe.

At a top end portion of the cylindrical body 5, a valve part 7 formed by the valve body 17 and a valve seat member 15 is formed. The valve seat member 15 has a step-shaped valve body accommodating hole 15*a* to accommodate the valve body 17. A conical surface is formed at a certain position inside the valve body accommodating hole 15*a*, and the valve seat (seal part) 15*b* is formed on this cone-shaped surface. A guide surface 15*c* to guide movement of the valve body 17 in a direction along the center axis line 1*a* is formed at an upstream side (a base end side) with respect to the valve seat 15*b* in the valve body accommodating hole 15*a*. In conjunction with the valve seat 15*b* and the valve body 17, a fuel passage is opened and closed. More specifically, when the valve body 17 is seated on the valve seat 15*b*, the fuel passage is closed, and when the valve body 17 separates from the valve seat 15*b*, the fuel passage is opened.

The valve seat member 15 is inserted to a top end inner side of the cylindrical body 5, and is fixed to the cylindrical body 5 by laser welding. The laser welding 19 is performed throughout an entire circumference of the cylindrical body 5 from an outer circumferential side of the cylindrical body 5. The valve body accommodating hole 15*a* penetrates the valve seat member in the direction along the center axis line 1*a*. A nozzle plate 21*n* is fixed to a lower end surface (a top end surface) of the valve seat member 15. The nozzle plate 21*n* closes an opening of the valve seat member 15 which is formed by the valve body accommodating hole 15*a*.

In the present embodiment, a fuel injection part 21 that jets swirl fuel is formed by the valve seat member 15 and the nozzle plate 21*n*. The nozzle plate 21*n* is fixed to the valve seat member 15 by laser welding. The laser welding portion 23 is performed throughout a circumference of an injection orifice providing area where fuel injection orifices 220-1, 220-2, 220-3 and 220-4 (see FIG. 3) are formed, so as to surround the injection orifice providing area. The valve seat member 15 can be fixed to the cylindrical body 5 by laser welding after being inserted and press-fitted to the top end inner side of the cylindrical body 5.

In the present embodiment, as the valve body 17, a ball valve having a spherical shape is used. Therefore, a plurality of cutting surfaces 17*a* are formed at some intervals in a circumferential direction of the valve body 17 at a portion facing the guide surface 15*c* of the valve seat member 15. These cutting surfaces 17*a* give clearances between an inner circumferential surface of the valve seat member 15 and the valve body 17, and the fuel passage is formed by these clearances. Here, the valve body 17 can be formed by an element other than the ball valve. For instance, a needle valve can be used.

In the present embodiment, the valve part 7 including the valve seat member 15 and the valve body 17, and the nozzle plate 21*n* form a nozzle part to jet the fuel. The nozzle plate 21*n* where after-mentioned fuel injection orifice 220 and swirl passage 210 (a transverse passage 211 and a swirl chamber 212) are formed is fixed to a top end surface of a nozzle part body (valve seat member 15) having the valve part 7.

A driving part 9 to drive the valve body 17 is disposed at a middle part of the cylindrical body 5. The driving part 9 is formed by an electromagnetic actuator. More specifically, the driving part 9 is formed by a fixed core 25, the movable element (a movable member) 27, an electromagnetic coil 29, and a yoke 33.

The fixed core 25 is made of magnetic metal material, and is press-fixed to an inside at the longitudinal direction middle part of the cylindrical body 5. The fixed core 25 is cylindrical in shape, and has a penetration hole 25*a* that penetrates the middle of the fixed core 25 in the direction along the center axis line 1*a*. The fixed core 25 can be fixed to the cylindrical body 5 by welding, or can be fixed to the cylindrical body 5 by press-fitting and the welding.

The movable element 27 is disposed at a top end side with respect to the fixed core 25 in the cylindrical body 5. A movable core 27*a* is provided at a base end side of the movable element 27. The movable core 27*a* faces the fixed core 25 through a slight gap δ. The movable element 27 is provided, at a top end side thereof, with a small diameter part 27*b*, and the valve body 17 is fixed to a top end of this small diameter part 27*b* by welding. In the present embodiment, the movable core 27*a* and the small diameter part 27*b* are integrally formed (as an integral member made of the same material). However, these two elements can be separately provided and fixed together. The movable element 27 has the valve body 17, and moves the valve body 17 in a valve open/closure direction. The valve body 17 touches (is seated on) the valve seat member 15, and also an outer circumferential surface of the movable core 27*a* touches an inner circumferential surface of the cylindrical body 5, thereby supporting and guiding movement in the direction along the center axis line 1*a* (in the valve open/closure direction) of the movable element 27 at these two points in the valve axis direction.

The movable core 27*a* is provided, at an end surface thereof which faces the fixed core 25, with a depressed portion 27*c*. A spring seat 27*e* of a spring (a coil spring) 39 is formed on a bottom surface of the depressed portion 27*c*. At an inner circumferential side of the spring seat 27*e*, a penetration hole 27*f* is formed so as to penetrate the small diameter part (the connecting part) 27*b* up to a top end side end portion of the small diameter part (the connecting part) 27*b* along the center axis line 1*a*. Furthermore, the small diameter part 27*b* is provided, at a side surface thereof, with an opening portion 27*d*. The penetration hole 27*f* opens to a bottom surface of the depressed portion 27*c*, and also the opening portion 27*d* opens to an outer circumferential surface of the small diameter part 27*b*, thereby forming the fuel flow passage 3 that communicates with the fuel passage 3 formed at the fixed core 25 and the valve part 7.

The electromagnetic coil 29 is inserted or fitted onto an outer circumference of the cylindrical body 5 in a position in which the fixed core 25 and the movable core 27*a* face each other through the slight gap δ. The electromagnetic coil 29 is wound around a tubular bobbin 31 that is made of resin material, and then is inserted or fitted onto the outer circumference of the cylindrical body 5. The electromagnetic coil 29 is electrically connected, through a wiring member 45, to a connector pin 43 that is provided at a connector 41. A driving circuit (not shown) is connected to the connector 41, and a driving current flows to the electromagnetic coil 29 through the connector pin 43 and the wiring member 45.

The yoke 33 is made of magnetic metal material. The yoke 33 is disposed at an outer circumferential side of the electromagnetic coil 29 so as to encircle the electromagnetic coil 29, and serves as a housing of the fuel injection valve 1. Furthermore, a lower end portion of the yoke 33 faces the outer circumferential surface of the movable core 27*a* through the cylindrical body 5, then in cooperation with the movable core 27*a* and the fixed core 25, the yoke 33 forms a closed magnetic path where magnetic flux generated by current supply to the electromagnetic coil 29 flows.

The coil spring 39 is set in a compressed state from the penetration hole 25*a* of the fixed core 25 to the depressed portion 27*c* of the movable element 27. The coil spring 39 functions as a forcing member that forces the movable element 27 in a direction (in a valve closure direction) in which the valve body 17 touches (is seated on) the valve seat 15*b*. An adjuster (an adjusting element) 35 is disposed inside the penetration hole 25*a* of the fixed core 25. A base end side end portion of the coil spring 39 touches a top end side end surface of the adjuster 35. By adjusting a position of the adjuster 35 in the direction along the center axis line 1*a* in the penetration hole 25*a*, an urging force of the movable element 27 (i.e. the valve body 17) by the coil spring 39 is adjusted.

The adjuster 35 has the fuel flow passage 3 that penetrates the middle of the adjuster 35 in the direction along the center axis line 1*a*. After the fuel flows in the fuel flow passage 3 of the adjuster 35, the fuel flows to the fuel flow passage 3 of a top end side portion of the penetration hole 25*a* of the fixed core 25, and then flows in the fuel flow passage 3 formed in the movable element 27.

The cylindrical body 5 is provided, at the top end portion thereof, with an O-ring 46. The O-ring 46 functions as a seal that air-tightly and liquid-tightly seals a gap between an inner circumferential surface of an insertion port 109*a* (see FIG. 15) formed at the internal combustion engine side and an outer circumferential surface of the yoke 33 when the fuel injection valve 1 is mounted in the internal combustion engine.

The fuel injection valve 1 is molded and covered by a resin cover 47 from the middle up to an almost base end side end portion of the fuel injection valve 1. A top end side end portion of the resin cover 47 covers a part of a base end side of the yoke 33. Furthermore, the resin cover 47 also covers the wiring member 45. The connector 41 is integrally formed with the resin cover 47.

Next, working of the fuel injection valve 1 will be explained.

When the electromagnetic coil 29 is not energized (i.e. when the driving current does not flow in the electromagnetic coil 29), the movable element 27 is forced in the valve closure direction by the coil spring 39, and the valve body 17 touches (is seated on) the valve seat 15*b*. In this case, the gap δ is present between a top end side end surface of the fixed core 25 and the base end side end surface of the movable core 27*a*. Here, in the present embodiment, this gap δ corresponds to a stroke of the movable element 27 (i.e. a stroke of the valve body 17).

When the electromagnetic coil 29 is energized and the driving current flows in the electromagnetic coil 29, the magnetic flux is generated in the closed magnetic path formed by the movable core 27*a*, the fixed core 25, and the yoke 33. A magnetic attraction force is then generated between the fixed core 25 and the movable core 27*a*, which face each other through the gap δ, by the magnetic flux. When this magnetic attraction force exceeds a resultant force of the urging force by the coil spring 39 and a fuel pressure that exerts on the movable element 27 in the valve closure direction, the movable element 27 starts moving in the valve open direction. Then when the valve body 17 separates from the valve seat 15*b*, a clearance (a fuel flow passage) is formed between the valve body 17 and the valve seat 15*b*, and injection of the fuel is started. In the present embodiment, when the movable element 27 moves by a distance δ that is equal to the gap δ in the valve open direction and the movable core 27*a* touches the fixed core 25, the movement in the valve open direction of the movable core 27*a* is stopped, and the movable core 27*a* is brought in a static valve open state.

When the driving current to the electromagnetic coil 29 is stopped, the magnetic attraction force diminishes, and then finally disappears. While the magnetic attraction force is diminishing, when the magnetic attraction force becomes smaller than the urging force of the coil spring 39, the movable element 27 starts moving in the valve closure direction. Then when the valve body 17 touches and is seated on the valve seat 15*b*, the valve body 17 of the valve part 7 is brought in a static valve closure state.

Figure 2:
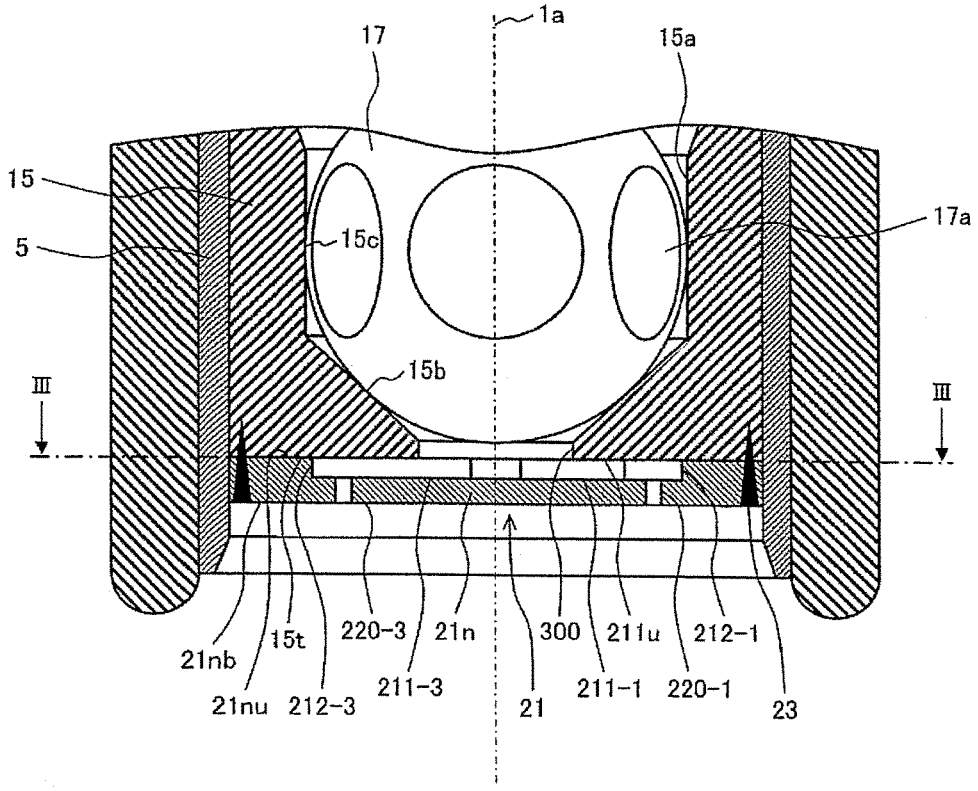
FIG. 2 is a longitudinal section drawing enlargedly showing a vicinity (a nozzle part) of a valve part and a fuel injection part of the fuel injection valve shown in FIG. 1 (corresponding to a cross section taken along a line II-II in FIG. 3).
Figure 3:
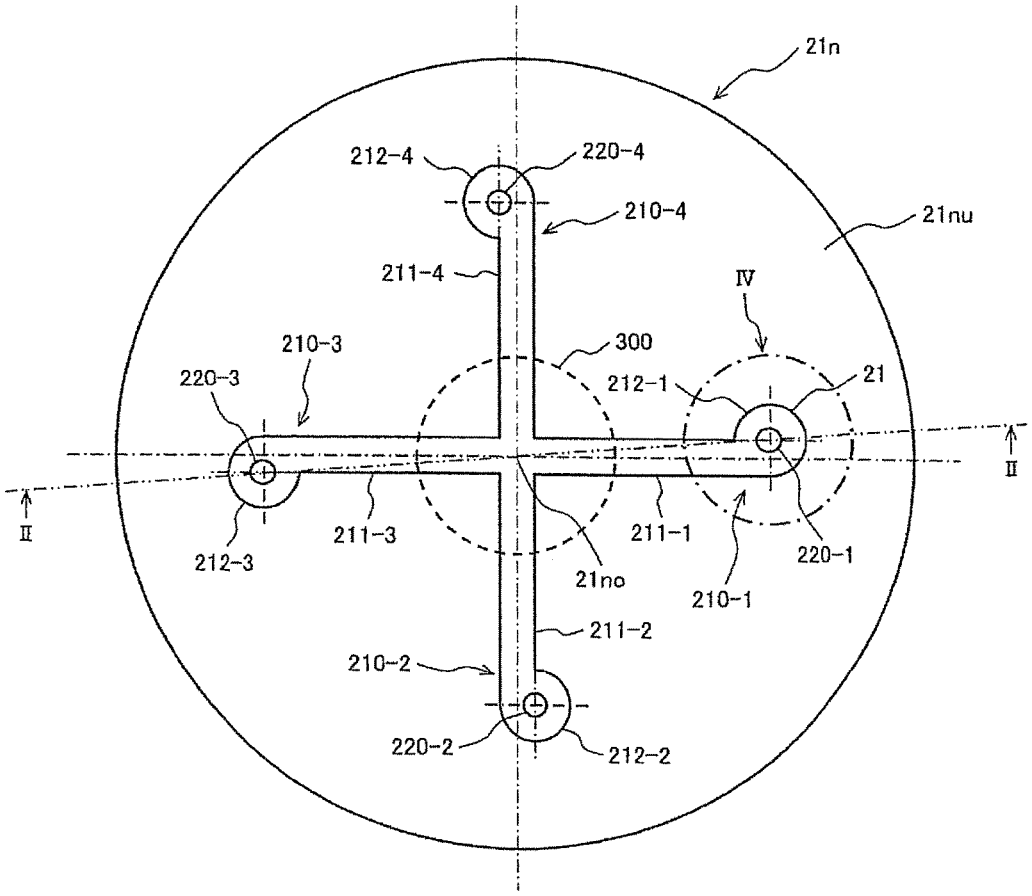
FIG. 3 is a plan view of the nozzle plate viewed from a line III-III in FIG. 1.

Next, each configuration of the valve part 7 and the fuel injection part 21 will be explained with reference to FIGS. 2 and 3. FIG. 2 is a longitudinal section drawing enlargedly showing a vicinity (a nozzle part) of a valve part 7 and a fuel injection part 21 of the fuel injection valve 1 shown in FIG. 1 (corresponding to a cross section taken along a line II-II in FIG. 3). FIG. 3 is a plan view of the nozzle plate 21*n* viewed from a line III-III in FIG. 1.

The top view of FIG. 3 is a top view of the nozzle plate 21*n* viewed from an entry side of the fuel injection orifice, and is a top view of an upper end surface 21*nu* side of the nozzle plate 21*n*. The upper end surface 21*nu* is a surface that faces a top end surface 15*t* of the valve seat member 15. An end surface of the nozzle plate 21*n*, which is an opposite side to the upper end surface 21*nu*, is a lower end surface 21*nb*.

In the present embodiment, as shown in FIG. 2, the nozzle plate 21*n* is formed by a plate member whose both end surfaces are flat, and the upper end surface 21*nu* and the lower end surface 21*nb* are parallel to each other. That is, the nozzle plate 21*n* is formed by a flat plate having a uniform thickness. Here, in the present embodiment, as shown in FIG. 3, the fuel injection valve 1 is configured so that the center axis line 1*a* crosses the nozzle plate 21*n* at a center 21*no*.

The top end surface (a lower end surface) 15*t* of the valve seat member 15 is formed by a flat surface that is perpendicular to the center axis line 1*a*. The nozzle plate 21*n* is fixed to the top end surface 15*t* of the valve seat member 15, and the top end surface 15*t* contacts or is contiguous to the upper end surface 21*nu* of the nozzle plate 21*n*.

As shown in FIG. 3, on the nozzle plate 21*n*, transverse passages 211-1, 211-2, 211-3 and 211-4, swirl chambers 212-1, 212-2, 212-3 and 212-4, and fuel injection orifices 220-1, 220-2, 220-3 and 220-4 are formed. The transverse passages 211-1, 211-2, 211-3 and 211-4 and the swirl chambers 212-1, 212-2, 212-3 and 212-4 form swirl passages 210-1, 210-2, 210-3 and 210-4 to provide a swirl force to the fuel in the upstream side of the fuel infection orifice 220. Four sets of swirl passages 210-1, 210-2, 210-3 and 210-4 and the fuel injection orifices 220-1, 220-2, 220-3 and 220-4 are formed in the same way as each other. Thus, in the following description, these are not distinguished, and these will be explained as the transverse passage 211, the swirl chamber 212 and the fuel injection orifice 220. However, in a case where structure or configuration of each set is changed, it will be explained as necessary.

As shown in FIG. 2, the conical valve seat 15*b* whose diameter is reduced toward the downstream side is formed at the valve seat member 15. A downstream end of the valve seat 15*b* is connected to a fuel introduction hole 300. A downstream end of the fuel introduction hole 300 opens to the top end surface 15*t* of the valve seat member 15. The fuel introduction hole 300 forms the fuel passage that introduces the fuel into the swirl passage 210.

In order for the swirl passage 210 to receive supply of the fuel from the fuel introduction hole 300, an upstream end portion of the transverse passage 211 is provided so as to face an opening surface of the fuel introduction hole 300. In the present embodiment, as shown in FIG. 3, the four transverse passages 211-1, 211-2, 211-3 and 211-4 are formed so that their upstream end portions communicate with each other. However, these four transverse passages 211-1, 211-2, 211-3 and 211-4 can be formed separately from each other.

In FIG. 2, the transverse passage 211, the swirl chamber 212 and the fuel injection orifice 220 are all formed on the nozzle plate 21*n* formed by one plate member. The nozzle plate 21*n* can be separated in a thickness direction, and be formed by a plurality of plates. For instance, the transverse passage 211 and the swirl chamber 212 are formed on one plate, and the fuel injection orifice 220 is formed on another plate. Then, by stacking or arranging these plates in layers, the nozzle plate 21*n* can be formed.

Furthermore, in the present embodiment, as shown in FIG. 2, the fuel injection orifice 220 is formed parallel to the center axis line 1*a*. However, the fuel injection orifice 220 can be formed so as to have an inclination angle that is greater than 0° with respect to the center axis line 1*a*. By differentiating an inclination direction of each fuel injection orifice 220, the fuel can be jetted in a plurality of directions.

In the present embodiment, as shown in FIG. 3, the swirl passage 210-1 and the fuel injection orifice 220-1 form one fuel passage, the swirl passage 210-2 and the fuel injection orifice 220-2 form one fuel passage, the swirl passage 210-3 and the fuel injection orifice 220-3 form one fuel passage, and the swirl passage 210-4 and the fuel injection orifice 220-4 form one fuel passage. The swirl passage 210-1 is formed by the transverse passage 211-1 and the swirl chamber 212-1, the swirl passage 210-2 is formed by the transverse passage 211-2 and the swirl chamber 212-2, the swirl passage 210-3 is formed by the transverse passage 211-3 and the swirl chamber 212-3, and the swirl passage 210-4 is formed by the transverse passage 211-4 and the swirl chamber 212-4.

In the present embodiment, the four fuel passage sets, each of which is formed by the swirl passage 210 and the fuel injection orifice 220, are provided on the nozzle plate 21*n*. Each of these four fuel passage sets is formed so as to extend radially from the center 21*no* side of the nozzle plate 21*n* toward an outer circumference of the nozzle plate 21*n*. That is, the transverse passage 211 is provided so as to extend radially from the center 21*no* side of the nozzle plate 21*n* toward the outer circumference of the nozzle plate 21*n* and is extended in a diameter direction of the nozzle plate 21*n*. Furthermore, the fuel passages are formed at angular intervals of 90° in a circumferential direction.

Regarding the number of the fuel passage sets, each of which is formed by the swirl passage 210 and the fuel injection orifice 220, it is not limited to four and it can be two or three, or five or more. Furthermore, only one set of the swirl passage 210 and the fuel injection orifice 220 may be formed.

Figure 4:
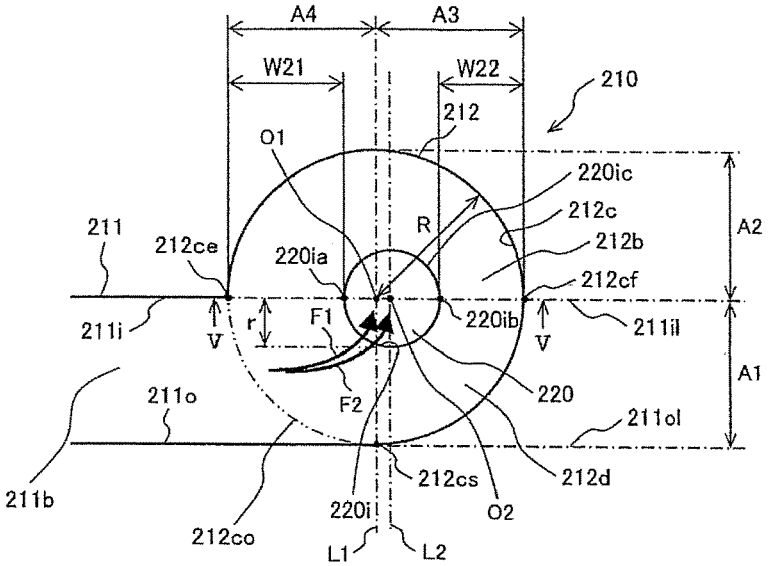
FIG. 4 is a plan view enlargedly showing a swirl chamber and a fuel injection orifice (an enlarged plan view of IV area in FIG. 3).

Here, a structural relationship between the swirl chamber 212 and the fuel injection orifice 220 will be explained in detail with reference to FIG. 4. FIG. 4 is a plan view enlargedly showing a swirl chamber 212 and a fuel injection orifice 220 (an enlarged plan view of IV area in FIG. 3).

The transverse passage 211 is connected to the swirl chamber 212 so as to be offset with respect to a center O1 of the swirl chamber 212. One width direction end part (side wall) 211*o* of the transverse passage 211 is connected to an inner circumferential wall 212*c* which is positioned in an upstream side in a flow direction of the swirl fuel, and the other width direction end part (side wall) 211*i* is connected to the inner circumferential wall 212*c* which is positioned in an downstream side in the flow direction of the swirl fuel. Therefore, the inner circumferential wall (side wall) 212*c* of the swirl chamber 212 has an opening 212*co* at the connection part of the transverse passage 211.

The inner circumferential wall 212*c* of the swirl chamber 212 is provided so as to form a circumference around the entry opening 220*i* of the fuel injection orifice 220 so that the fuel flowing into the swirl chamber 212 from the transverse passage 211 swirls. That is, a swirl flow passage 212*d* for the fuel is formed between the inner circumferential wall 212*c* of the swirl chamber 212 and the entry opening 220*i* of the fuel injection orifice 220.

The transverse passage 211 has a rectangular in shape in cross section (transverse section) that is perpendicular to the extending direction of the transverse passage 211 or the fuel flow direction. Side walls (side surfaces) 211*o* and 211*i* and a bottom surface 211*b* of the transverse passage 211 are formed by the nozzle plate 21*n*. Furthermore, an upper surface (a ceiling surface) 211*u* (see FIG. 2) of the transverse passage 211 is formed by the top end surface 15*t* of the valve seat member 15.

The side wall 211*o* of the transverse passage 211 is connected to the swirl chamber 212 at an angle in contact with the inner circumferential wall 212*c* of the swirl chamber 212. A downstream end of the side wall 211*o* is connected to a wall starting end portion 212*cs* of the inner circumferential wall 212*c* of the swirl chamber 212.

Furthermore, the side wall 211*i* of the transverse passage 211 is connected to the swirl chamber 212 at an angle where it intersects the inner circumferential wall 212*c* of the swirl chamber 212. Here, "intersect" means that the side wall 211*i* and its extension line are going across the inner circumferential wall 212*c*, and doesn't include a configuration that the side wall 211*i* and its extension line are in contact with the inner circumferential wall 212*c*. A downstream end of the side wall 211*i* is connected to a wall ending end portion 212*ce* of the inner circumferential wall 212*c* of the swirl chamber 212.

The wall starting end portion 212*cs* of the inner circumferential wall 212*c* of the swirl chamber 212 is an end portion which is positioned in the upstream side in the swirl direction of the fuel. The wall ending end portion 212*ce* of the inner circumferential wall 212*c* is an end portion which is positioned in the downstream side in the swirl direction of the fuel. In the wall ending end portion 212*ce*, a chamfering portion such as an inclined or rounded portion is sometimes formed. In such a case, an intersection point where imaginary lines which are formed by respectively extending the inner circumferential wall 212*c* and the side wall 211*i* intersect each other should be defined as the wall ending end portion (downstream side end portion) 212*ce*.

In the present embodiment, the inner circumferential wall 212*c* from the wall starting end portion 212*cs* of the swirl chamber 212 to the wall ending end portion 212*ce* is formed so as to be an arc shape in which radius R from the center O1 of the swirl chamber 212 is constant. That is, the inner circumferential wall 212*c* is formed by a part of a circumference of a perfect circle. On the other hand, the entry opening 220*i* of the fuel injection orifice 220 has a circular shape having a radius r smaller than the radius R of the inner circumferential wall 212*c* of the swirl chamber 212. With this structure, a bottom surface 212*b* of the swirl flow passage 212*d* is formed between the entry opening edge 220*ic* of the fuel injection orifice 220 and the inner circumferential wall 212*c* of the swirl chamber 212. Furthermore, in case that a center axis line of the fuel injection orifice 220 inclines with respect to the bottom surface 212*b*, even if a transverse section of the fuel injection orifice 220 has a circular shape, the entry opening 220 is elliptic, not circular. Regardless of the presence/absence of inclining, the center axis line of the fuel injection orifice 220 passes through a center O2 of the entry opening 220*i*.

FIG. 4 is a plan view and a projection drawing where the fuel injection orifice 220, the swirl chamber 212, and the transverse passage 211 are projected to a plane surface (projection plane) vertical to the center axis line 1*a* of the fuel injection valve 1. In FIG. 4, an extension line 211*ol* (first extension line) of the side wall 211*o* of the transverse passage 211 and an extension line 211*il* (second extension line) of the side wall 211*i* are shown by projecting. The first extension line 211*ol* is an imaginary line extending along the side wall 211*o*. The second extension line 211*il* is an imaginary line extending along the side wall 211*i*.

The second extension line 211*il* divides the bottom surface of the swirl chamber 212 (bottom surface 212*b* of the swirl flow passage 212*d*) into two areas A1 and A2. The area A1 is an area which is located in the side wall 211*o* or its extension line 211*ol* side with respect to the second extension line 211*il*. The wall starting end portion 212*cs* of the inner circumferential wall 212*c* is in the area A1, and formed by a swirl flow passage part in the wall starting end portion 212*cs* side of the inner circumferential wall 212*c*. The area A2 is an area positioned in an opposite side to the side wall 211*o* or its extension line 211*ol* side with respect to the second extension line 211*il*. The area A2 is formed by a swirl flow passage part in the wall ending end portion 212*ce* side of the inner circumferential wall 212*c*. Furthermore, it is defined that the areas A1 and A2 don't include the second extension line 211*il* itself.

A part of the entry opening edge 220*ic* of the fuel injection orifice 220 is arranged in the area A1 side over the second extension line 211*il*. That is, a part of the entry opening 220*i* of the fuel injection valve 220 opens toward the area A1 side.

In the present embodiment, the center O2 of the entry opening 200*i* of the fuel injection orifice 220 is positioned on the second extension line 211*il*. Because of this, the entry opening 220*i* of the fuel injection orifice 220 is protruded toward the area A1 side over the second extension line 211*il* by the radius r of the fuel injection orifice 220. Therefore, the entry opening edge 220*ic* of the fuel injection orifice 220 intersects with the second extension line 220*il* at two points 220*ia* and 220*ib*. That is, the entry opening 220*i* of the fuel injection orifice 220 is arranged so that the second extension line 220*il* and the entry opening edge 220*ic* of the fuel injection orifice 220 are intersected at the two points 220*ia* and 220*ib*. Furthermore, a protrusive degree of the entry opening 220*i* toward the area A1 side is not limited to the size of the radius r of the fuel injection orifice 220. The protrusive degree may be bigger than the radius r and may be smaller than the radius r.

In the present embodiment, in addition, the center O2 of the entry opening 200*i* of the fuel injection orifice 220 is arranged at a position which is shifted from the center O1 of the swirl chamber 212 in a direction along the second extension line 211*il*. That is, the center O2 of the entry opening 220*i* of the fuel injection orifice 220 is eccentric with respect to the center O1 of the swirl chamber 212.

Here, divisions of the swirl chamber 212, which are different from the area A1 and A2, will be explained. First, a line segment L1, which pass through the center O1 of the swirl chamber 212 and is perpendicular to the second extension line 211*i*, is imaged. Next, the swirl chamber 212 is divided into two areas A3 and A4 by the line segment L1. The area A3 is a division opposite to a side where the transverse passage 211 is connected with respect to the line segment L1. The area A4 is a division in a side where the transverse passage 211 is connected with respect to the line segment L1. The area A4 is formed of an uppermost upstream side section and a lowermost downstream side section of the swirl flow passage 212*d*. The area A3 is formed of a middle flow passage section of the swirl flow passage 212*d*. Furthermore, it is defined that the areas A3 and A4 don't include the line segment L1 itself.

A shifting direction of the center O2 is a direction along the second extension line 211*il* and is in a side of an intersection point 212*cf* positioned in an opposite side to the wall ending end portion 212*ce* of the inner circumferential wall 212*c* across the entry opening 220*i* of the fuel injection orifice 220. The intersection point 212*cf* is the intersection point of the second extension line 211*il* and the inner circumferential wall 212*c*.

In the present embodiment, as the center O1 of the swirl chamber 212 and the center O2 of the entry opening 220*i* are arranged on the second extension line 211*il*, the center O2 of the entry opening 220*i* exists at a position which is shifted from the center O1 of the swirl chamber 212 toward the intersection point 212*cf* on the second extension line 211*il*. Furthermore, on the second extension line 211*il*, the center O2 of the entry opening 210*i* is arranged in the area A3 near to the 212*cf* side than the center O1, which is a center point dividing a distance between the intersection point 212*cf* and the wall ending end portion 212*ce* into two equal parts.

However, the shifting direction of the center O2 is not limited to the direction disclosed in the present embodiment, and may be disposed so that the center O2 of the entry opening 220*i* is positioned in the area A3. In this case, a line segment (imaginary line segment) L2, which passes through the center O2 of the entry opening 220*i* and is perpendicular to the second extension line 211*il*, doesn't overlap with the imaginary line segment L1 and is parallel to the imaginary line segment L1. That is, there is a substantially distance between the imaginary line segment L1 and the imaginary line segment L2, and they have a parallel relationship each other. Here, the term "there is a substantially distance" means that a case that the distance is zero is not included.

As compared with a case that the center O2 of the entry opening 220*i* of the fuel injection orifice 220 corresponds to the center O1 of the swirl chamber 212, the center O2 is arranged in the intersection point 212*cf* side. Therefore, in a flow passage width W21 and a flow passage width W22, which are formed in both sides of the entry opening 220*i* in the direction of the second extension line 211*il*, the flow passage width W22 is narrower than the flow passage width W21. The flow passage width W21 corresponds to a distance between the wall ending end portion 212*ce*, which is an imaginary intersection point of the second extension line 211*il* and the inner circumferential wall 212*c*; and a first intersection point 220*ia* of the second extension line 211*il* and the entry opening edge 212*ic*. The flow passage width W22 corresponds to a distance between a second intersection point 220*ib* of the second extension line 211*il* and the entry opening edge 212*ic*; and the intersection point 212*cf* of the second extension line 211*il* and the inner circumferential wall 212*c*, the intersection point 212*cf* being in the wall starting end portion 212*cs* side.

Figure 5:
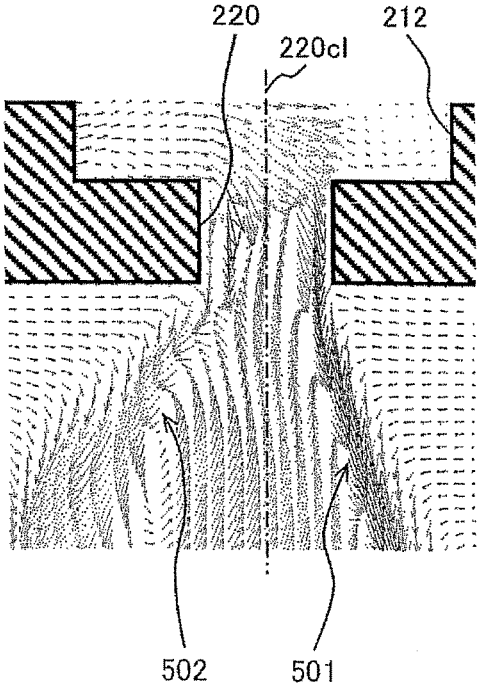
FIG. 5 is a drawing showing an analytical result of a fuel flow at a cross section taken along a line V-V in FIG. 4.

A fuel flow, which flows into the fuel injection orifice 220 from the swirl chamber 212 and is jetted from the fuel injection orifice 220, will be explained with reference to FIG. 5. FIG. 5 is a drawing showing an analytical result of a fuel flow at a cross section taken along a line V-V in FIG. 4.

The fuel flow flowing into the swirl chamber 212 from the transverse passage 211 flows along the inner circumferential wall 212*c* of the swirl chamber 212, and swirls around the entry opening 220*i* of the fuel injection orifice 220. At this stage, the fuel is provided with the swirl force. The fuel flow provided with the swirl force flows into the fuel injection orifice 220 while swirling. The fuel jetted from the fuel injection orifice 220 forms a liquid film while keeping the swirl force, and further spreads as a droplet state. Atomized fuel spray is then formed.

In the present embodiment, the entry opening 220*i* of the fuel injection orifice 220 is formed so as to protrude toward the area A1 side over the extension line 211*il* of the side wall 211*i*, so a part of fuel flowing into the swirl chamber 212 from the transverse passage 211 flows into the fuel injection orifice 220 without swirling in the swirl chamber 212. That is, the fuel tends to flow into the fuel injection orifice 220. A tendency of flowing into the fuel injection orifice 220 in a fuel flow can be adjusted by modifying a protruding degree toward the area A1 side in the fuel injection orifice 220. Thereby, a flow volume of a fuel flowing into the fuel injection orifice 220, that is, injection amount can be adjusted. Generally, when the protruding degree toward the area A1 side is increased, the flow volume of fuel flowing into the fuel injection orifice 220 (injection amount) is increased.

In FIG. 5, as a shade of an arrow showing the fuel flow becomes darker, the flow velocity increases. In the present embodiment, in a 501 side where the fuel flows into the fuel injection orifice 220 without sufficiently swirling in the swirl chamber 212, a fuel velocity in an axial direction of the fuel injection orifice 220 (axial direction velocity) is large, and a fuel spray with strong penetration force is formed. Furthermore, in the 501 side, a spray angle is small, and penetration is long. On the other hand, in a 502 side, a fuel flow which has gotten a swirl force by swirling in the swirl chamber 212 is jetted from the fuel injection orifice 220. Therefore, as compared with in the 501 side, in the 502 side, an axial direction velocity of the fuel is small, and a fuel spray with weak penetration force is formed. Furthermore, as compared with in the 501 side, in the 502 side, the swirl force is strong, so the spray angle is large, and the penetration is short.

Furthermore, in the present embodiment, the center O2 of the entry opening 220*i* of the fuel injection orifice 220 is shifted from the center O1 of the swirl chamber 212 to be arranged in the area A3 shown in FIG. 4. That is, the center O2 of the entry opening 220*i* of the fuel injection orifice 220 is arranged at a position shifted from the center O1 of the swirl chamber 212 toward the intersection point 212*cf* side in a direction along the second extension line 211*il*. By adjusting a shift amount in the direction along the second extension line 211*il* from the center O1 of the swirl chamber 212, the spray angle of the fuel spray can be adjusted.

Furthermore, in a comparison between flow velocity of the fuel flow F2 and flow velocity of the fuel flow F1, the flow velocity of the fuel flow F2 is faster than the flow velocity of the fuel flow F1. The fuel flow F1 is a flow that the fuel flowed into the swirl chamber 212 tries to flow into the fuel injection orifice 220 in further upstream side. The fuel flow F2 is a flow that the fuel flowed into the swirl chamber 212 tries to flow into the fuel injection orifice 220 in further downstream side.

The fuel flow having a fast fuel velocity can be flowed into the fuel injection orifice 220 by shifting the center O2 of the entry opening 220*i* of the fuel injection orifice 220 toward the area A3 side with respect to the imaginary line segment L1. Because of this, rectilinearity of the fuel flow inside the fuel injection orifice 220 increases, and velocity component in a direction of a center axis line 220*c*1 of the fuel injection orifice 220 gets large. The rectilinearity of the fuel flow inside the fuel injection orifice 220 increases, and thereby the spray angle of the fuel spray jetted from the fuel injection orifice 220 can be narrow. Therefore, the present embodiment is available in case that not only adjustment of the spray angle in the fuel spray but also the fuel spray with a narrow spray angle is required.

Figure 6:
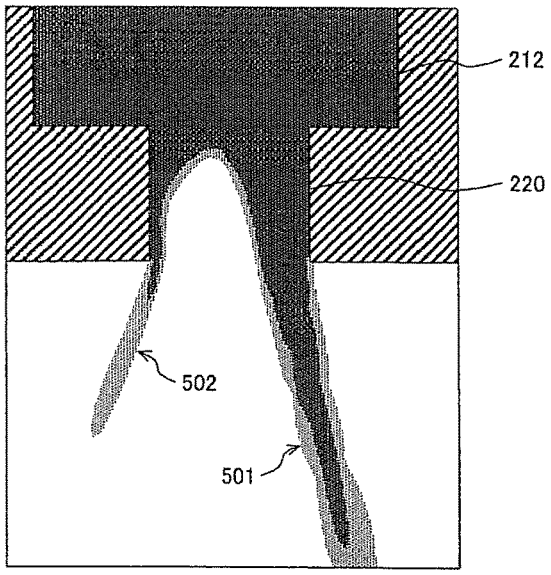
FIG. 6 is a longitudinal section drawing (a cross section taken along a V-V line in FIG. 4) showing a fuel liquid film distribution in an inside of the fuel injection orifice and a vicinity thereof, when arranging an entry opening of the fuel injection orifice in a center of the swirl chamber.
Figure 7:
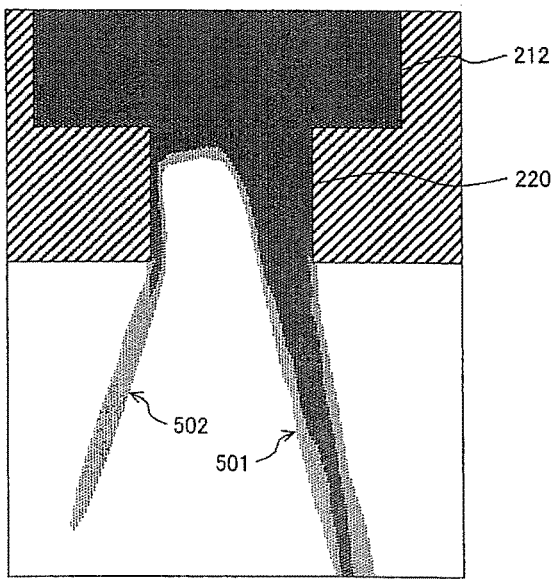
FIG. 7 is a longitudinal section drawing (a cross section taken along a V-V line in FIG. 4) showing a fuel liquid film distribution in an inside of the fuel injection orifice and a vicinity thereof, when arranging an entry opening to be shifted to area A3 side from the center of the swirl chamber.

Here, a fuel liquid film distribution formed in the fuel injection orifice in the present embodiment will be explained with reference to FIG. 6 and FIG. 7. FIG. 6 is a longitudinal section drawing (a cross section taken along a V-V line in FIG. 4) showing a fuel liquid film distribution in an inside of the fuel injection orifice and a vicinity thereof, when arranging an entry opening of the fuel injection orifice in a center of the swirl chamber. FIG. 7 is a longitudinal section drawing (a cross section taken along a V-V line in FIG. 4) showing a fuel liquid film distribution in an inside of the fuel injection orifice and a vicinity thereof, when arranging an entry opening to be shifted to area A3 side from the center of the swirl chamber. Furthermore, in FIG. 6 and FIG. 7, a state of the liquid film is shown with two kinds of shade. A dark part is where a proportion of the fuel is 100%, and a pale part is where the proportion of the fuel is less than 100% because air is mixed therein.

In both of FIG. 6 and FIG. 7, the fuel liquid film of the 501 side is thicker as compared with the fuel liquid film of the 502 side.

However, in comparison between FIG. 6 and FIG. 7, it is found that the liquid film in the 502 side is very thin inside the fuel injection orifice 220 in FIG. 7, with respect to FIG. 6. Conversely, in the 501 side, the fuel flowing amount to the fuel injection orifice 220 increases, so the fuel liquid film gets thick. Furthermore, rectilinearity of the fuel flowing into the fuel injection orifice 220 increases, so the fuel spray travel gets long. The 501 side is located in the upstream side with respect to the 502 side in the swirl direction of the fuel.

Figure 8:
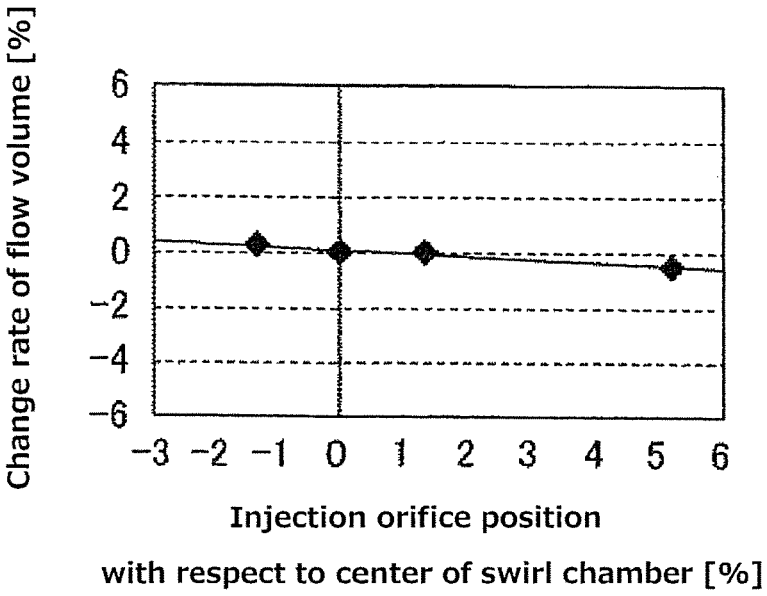
FIG. 8 is a drawing showing an analytical result of a change rate of flow volume in the embodiment of the present invention, when a position of the entry opening of the fuel injection orifice is changed.
Figure 9:
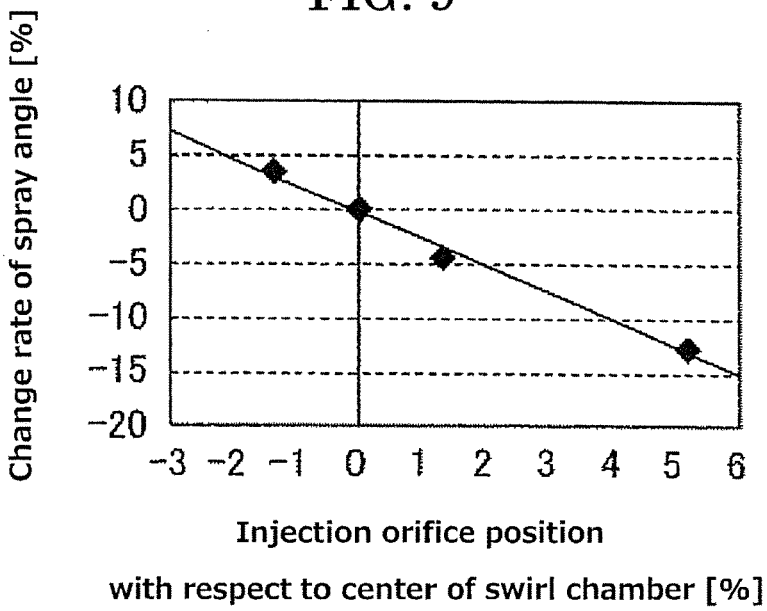
FIG. 9 is a drawing showing an analytical result of a change rate of spray angle in the embodiment of the present invention, when a position of the entry opening of the fuel injection orifice is changed.

Change rates of a fuel injection amount (flow volume) and spray angle in the present embodiment will be explained with reference to FIG. 8 and FIG. 9. FIG. 8 is a drawing showing an analytical result of a change rate of flow volume in the present embodiment, when a position of the entry opening of the fuel injection orifice is changed. FIG. 9 is a drawing showing an analytical result of a change rate of spray angle in the present embodiment, when a position of the entry opening of the fuel injection orifice is changed. Furthermore, in FIG. 8 and FIG. 9, the horizontal axis represents a ratio of a shift amount in an opening position of the entry opening 220*i* with respect to a diameter of the swirl chamber 212.

As found from FIG. 8 and FIG. 9, when the opening position of the entry opening 220*i* is shifted, the spray angle largely changes, but the flow volume hardly changes. That is, according to the structure of the present embodiment, even if the spray angle is adjusted after the fuel injection amount is adjusted, the spray angle can be adjusted without changing the fuel injection amount. Furthermore, from FIG. 9, it is found that the spray angle gets narrow by shifting the center O2 of the entry opening 220*i* toward the area A3 side.

In the present embodiment, it is possible to adjust the spray angle in the fuel spray by shifting the center O2 of the entry opening 220*i* toward the area A3 and arranging it, after the fuel injection amount is determined by adjusting the protrusive degree of the entry opening 220*i* of the fuel injection orifice 220 toward the area A1 side. Therefore, to adjust the fuel injection amount and the spray angle is made to be easy, so design freedom of the fuel injection valve can be improved.

Figure 10:
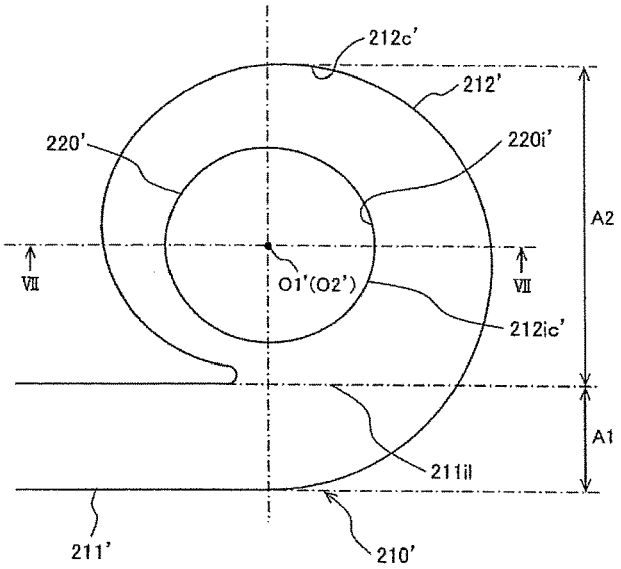
FIG. 10 is a plan view showing a configuration of a transverse passage, a swirl chamber, and a fuel injection orifice in a comparative example.
Figure 11:
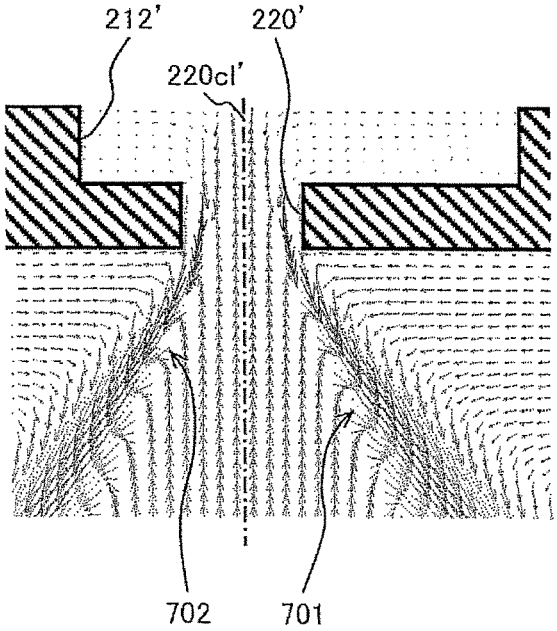
FIG. 11 is a drawing showing an analytical result of a fuel flow at a cross section taken along a line VII-VII in FIG. 10.

In a comparative example, a fuel flow, which flows into the fuel injection orifice 220' from the swirl chamber 212' and is jetted from the fuel injection orifice 220', will be explained with reference to FIG. 10 and FIG. 11. FIG. 10 is a plan view showing a configuration of a transverse passage, a swirl chamber, and a fuel injection orifice in a comparative example. FIG. 11 is a drawing showing an analytical result of a fuel flow at a cross section taken along a line VII-VII in FIG. 10.

As for the comparative example shown in FIG. 10, the whole of an entry opening 220*i*' of the fuel injection orifice 220' is located at the area A1 side with respect to the extension line (second extension line) 211*il* of the side wall 211*i*. That is, the second extension line 211*il* doesn't intersect the opening edge 212*ic*' of the entry opening 220*i*. In this case, the fuel flow provided with the swirl force flows throughout an entire circumference of the entry opening 220*i*' of the fuel injection orifice 220'. Because of this, in the case of the comparative example, as shown in FIG. 11, as the spray form, the spray angle and the fuel flow velocity in a 701 side and the spray angle and the fuel flow velocity in a 702 side are equal to each other.

In the present embodiment, in the 501 side, since the swirl force of the fuel flow is weak, an atomization effect using the swirl force is reduced. However, since the center axis 220*lcl'* direction velocity is high, an atomization performance can be prevented from lowering, or can be kept or improved by using frictional heat between the fuel flow and the air. Accordingly, in the present embodiment, it is possible to readily adjust the fuel injection amount while suppressing the lowering of the atomization performance. Furthermore, as described above, although the spray form of the fuel (the angle and size of the spray or droplet) is changed, as compared with a case where cross-sectional areas of the transverse passage 211 and the fuel injection orifice 220 are changed in order to adjust the fuel flow volume, a change amount of the spray form can be small.

The entry opening 212*i* of the fuel injection orifice 220 is protruded toward the area A1 side, and the protrusive degree is modified. Thereby, the fuel injection amount can be adjusted. Here, when to adjust the spray angle is required, the protrusive degree to the area A1 side in the entry opening 212*i* is modified in order to adjust the spray angle, and thereby, the fuel injection amount is also changed. If design of an orifice diameter of the fuel injection orifice, length of the fuel injection orifice, a size (diameter) of the swirl chamber, etc. is redone in order to adjust both of the fuel injection amount and the spray angle, considerable labor and time are needed.

Hereinafter, a modified example where the shape of the swirl chamber 212 according to the present invention will be explained with reference to FIGS. 12 to 14.

In FIG. 4, the inner circumferential wall 212*c* of the swirl chamber 212 is formed into a perfect circle. However, as shown in FIG. 12 to FIG. 14, the inner circumferential wall 212*c* of the swirl chamber 212 may be formed into a spiral shape such as a spiral curve or an involute curve. Furthermore, in case that the inner circumferential wall 212*c* is formed with the spiral curve, the center O1 of the swirl chamber 212 corresponds to a swirl center of the spiral curve. Furthermore, in case that the inner circumferential wall 212*c* is formed with the involute curve, the center O1 of the swirl chamber 212 corresponds to a center of a base circle. In this manner, the center O1 of the swirl chamber 212 is defined as a geometric center or a center of circle set for construction.

Figure 12:
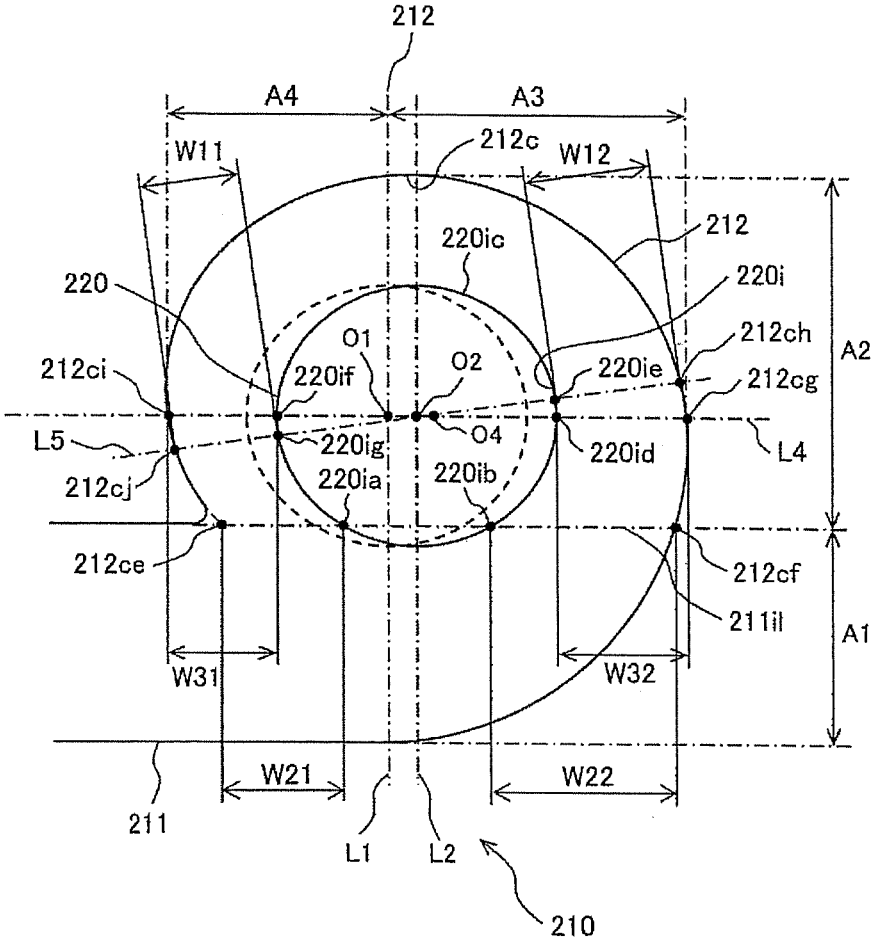
FIG. 12 is a plan view enlargedly showing a swirl chamber and a fuel injection orifice in an example where a shape of the swirl chamber is modified (the enlarged plan view of IV area in FIG. 3).

FIG. 12 is a plan view enlargedly showing a swirl chamber and a fuel injection orifice in an example where a shape of the swirl chamber is modified (the enlarged plan view of IV area in FIG. 3).

The inner circumferential wall 212*c* of the swirl chamber 212 in the present embodiment is formed with a spiral curve or an involute curve. The second extension line 211*il*, the areas A1 to A4, and the imaginary line segments L1, L2 are defined as well as in FIG. 4. In FIG. 12, the entry opening 220*i* in case that the center O2 of the entry opening 220*i* of the fuel injection orifice 220 is arranged on the center O1 of the swirl chamber 212 is shown with a broken line.

The entry opening 220*i* of the fuel injection orifice 220 is protruded toward the area A1 side over the second extension line 211*il*. Therefore, the second extension line 211*il* intersects with the entry opening edge 220*ic* of the fuel injection orifice 220 at two intersection points 220*ia* and 220*ib*.

Furthermore, the center O2 of the entry opening 220*i* of the fuel injection orifice 220 is located at a position separated from the center O1 of the swirl chamber 212, and arranged in the area A3. As well as in FIG. 4, there is a substantially distance between the imaginary line segment L1 and the imaginary line segment L2, and they have a parallel relationship each other.

Although the center O2 of the entry opening 220*i* is arranged in the area A3, it is disposed in the intersection point 212*ci* side with respect to a center point O4 which divides a distance between the intersection point 212*cg* and the intersection point 212*ci* into two equal parts on the line segment L4. The line segment L4 is an imaginary line segment which passes through the center O1 of the swirl chamber 212 and the center O2 of the entry opening 220*i*, and is parallel to the second extension line 211*il*. Although there is no need that the imaginary line segment L4 and the second extension line 211*il* are parallel each other, hereinafter the case where the imaginary line segment L4 and the second extension line 211*il* are parallel each other will be explained.

In the present example, the center O2 of the entry opening 220*i* is located at a position separated from the center O1 of the swirl chamber 212, and arranged in the area A3. However, in flow passage width W21 and W22, which are formed in both sides of the entry opening 220*i* on the second extension line 211*il*, the flow passage width W22 is larger than the flow passage width W21. The flow passage width W21 is a gap (distance) between the wall ending end portion 212*ce* and the intersection point 220*ia*. The flow passage width W22 is a gap (distance) between the intersection point 220*ib* and the intersection point 220*cf*. The wall ending end portion 212*ce* and the intersection points 220*ia*, 220*ib*, 220*cf* are defined as well as in FIG. 4.

In flow passage width W31 and W32, which are formed in both sides of the entry opening 220*i* on the imaginary line segment L4, the flow passage width W32 is larger than the flow passage width W31. The flow passage width W31 is a gap (distance) between the intersection point 212*ci* and the intersection point 220*if*. The flow passage width W32 is a gap (distance) between the intersection point 220*id* and the intersection point 220*cg*. The intersection points 212*cg* and 212*ci* are intersection points of the imaginary line segment L4 and the inner circumferential wall 212*c*. The intersection points 212*id* and 212*if* are intersection points of the imaginary line segment L4 and the entry opening edge 220*ic*.

Furthermore, in the present example, a flow passage width W11 and W12, which cannot be defined in FIG. 4, can be defined. The flow passage width W11 and W12 are formed in both sides of the entry opening 220*i* on a line segment L5. The flow passage width W12 is larger than the flow passage width W11. The line segment L5 is an imaginary line segment which passes through the center O2 of the entry opening 220*i* and the center 21*no* of the nozzle plate 21*n*. The flow passage width W11 is a gap (distance) between the intersection point 212*cj* and the intersection point 220*ig*. The flow passage width W12 is a gap (distance) between the intersection point 212*ie* and the intersection point 220*ch*. The intersection points 212*ch* and 212*cj* are intersection points of the imaginary line segment L4 and the inner circumferential wall 212*c*. The intersection points 220*ie* and 220*ig* are intersection points of the imaginary line segment L4 and the entry opening edge 220*ic*.

Also according to the structure of the present example, the same effect as the structure in FIG. 4 can be obtained.

Figure 13:
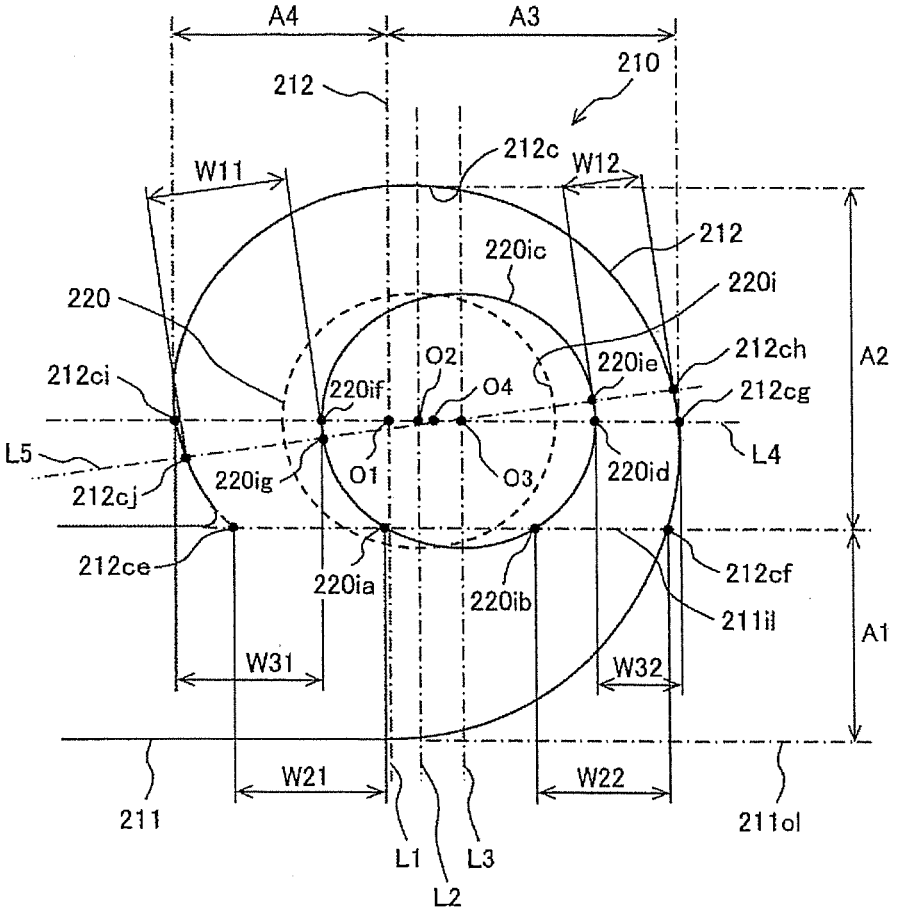
FIG. 13 is a plan view showing an example where a position of the fuel injection valve with respect to the swirl chamber is changed in the modified example of FIG. 12.

FIG. 13 is a plan view showing an example where a position of the fuel injection valve with respect to the swirl chamber is changed in the modified example of FIG. 12. The second extension line 211*il*, the areas A1 to A4, and the imaginary line segments L1, L2 are defined as well as in FIG. 4. Furthermore, the imaginary line segments L4, L5, and the flow passage width W11, W12, W21, W22, W31, W32 are defined as well as in FIG. 12.

In the present example, the center of the fuel injection orifice 220 is further shifted from a position of the center O2 to a position of the center O3. In FIG. 13, the entry opening 220*i* in case that the center of the entry opening 220*i* of the fuel injection orifice 220 is located at the position of O2 in FIG. 12 is shown with a broken line. Furthermore, the line segment L3 is an imaginary line segment which passes through the center O3 of the fuel injection orifice 220 and a perpendicular line segment to the second extension line 211*il*.

The center O3 of the entry opening 220*i* is arranged in the area A3 and in the intersection point 212*cf* side with respect to the center O4, which divides a distance between the intersection point 212*cf* and the wall ending end portion 212*ce* into two equal parts on the line segment L4.

In the present example, the flow passage width W22 is smaller than the flow passage width W21. The flow passage width W12 is smaller than the flow passage width W11. The flow passage width W32 is smaller than the flow passage width W31. In this manner, even if the inner circumferential wall 212*c* of the swirl chamber 212 is formed with a spiral curve or an involute curve, it is possible that the flow passage width W12, W22, or W32 is small with respect to the flow passage width W11, W21, or W31.

Also according to the structure of the present example, the same effect as the structure in FIG. 4 can be obtained.

Figure 14:
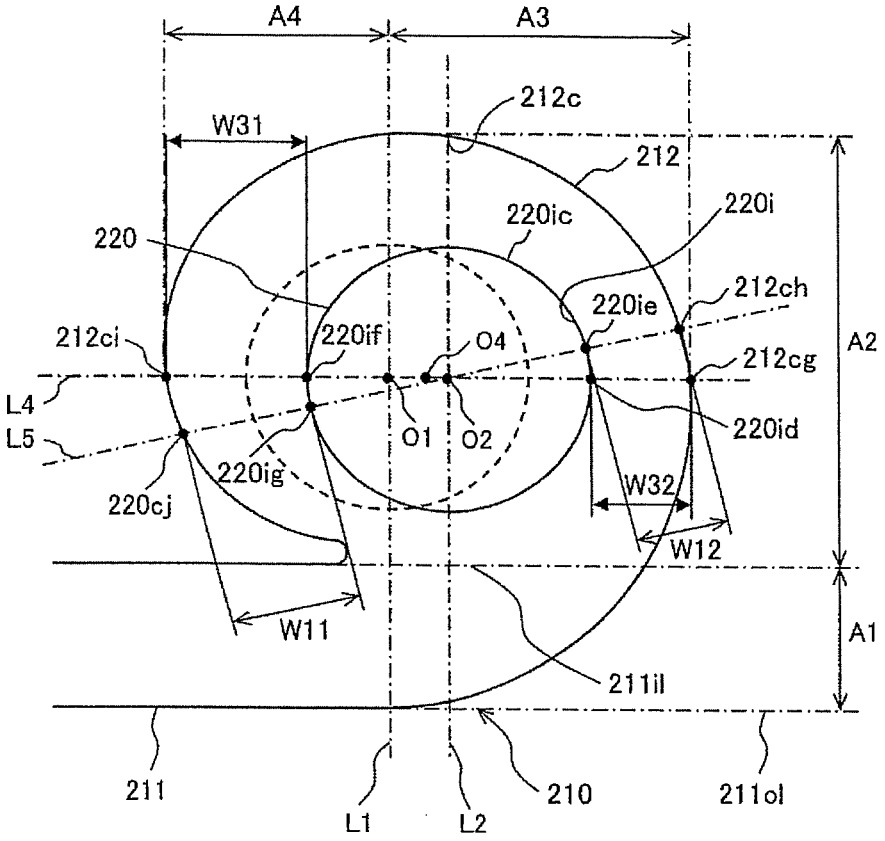
FIG. 14 is a plan view enlargedly showing the swirl chamber and the fuel injection orifice in the example where the shape of the swirl chamber is further modified (the enlarged plan view of IV area in FIG. 3).

FIG. 14 is a plan view enlargedly showing the swirl chamber and the fuel injection orifice in the example where the shape of the swirl chamber is further modified (the enlarged plan view of IV area in FIG. 3). The second extension line 211*il*, the areas A1 to A4, and the imaginary line segments L1, L2 are defined as well as in FIG. 4. Furthermore, the imaginary line segments L4, L5, the flow passage width W11, W12, W31, W32, and the center point O4 are defined as well as in FIG. 12.

The inner circumferential wall 212*c* of the swirl chamber 212 in the present example is formed with a spiral curve or an involute curve. However, the whole of an entry opening 220*i* of the fuel injection orifice 220 is formed in the center O1 side of the swirl chamber 212 with respect to the second extension line 211*il*.

In such a form, the flow passage width W21 and W22 cannot be defined. However, the flow passage width W11, W12, W21, and W22 can be defined as well as in FIG. 12 and FIG. 13. Furthermore, in the flow passage width W11 and W12, the flow passage width W12 can be large or small with respect to the flow passage width W11. Furthermore, in the flow passage width W31 and W32, the flow passage width W32 can be large or small with respect to the flow passage width W31. Regarding to the large/small relation among the flow passage width W11, W12, W21, and W22, the relation is determined depend on a positional relation of the center O2 of the entry opening 220*i* with respect to the center point O4, and is the same relation as in FIG. 12 and FIG. 13.

In the case of the present example, an effect of adjusting a flow volume depending on protruding the entry opening 220*i* of the fuel injection orifice 220 toward the area A1 side cannot be obtained. However, by arranging the center of the entry opening 220*i* of the fuel injection orifice 220 in the area A3 side, an effect of narrowing the spray angle or an effect of adjusting the spray angle can be obtained.

Furthermore, all of the line segments L1 to L5 described above are straight lines.

In a comparative example in FIG. 10, the entry opening 220*i*' of the fuel injection orifice 220' is arranged so that its center O2' corresponds to the center O1' of the swirl chamber 212'. Thereby, it is possible to maximize a velocity component in the swirl direction of the fuel flowing into the fuel injection orifice 220'. On the other hand, in the embodiment and the modified example described above, the center O2 of the entry opening 220*i* is shifted from the center O1 (first position) of the swirl chamber 212 to a second position, and arranged. The first position is where the velocity component in the swirl direction of the fuel can be maximized. The second position is where the velocity component in the swirl direction is reduced, and where a velocity component in a center axis line 220*cl* direction of the fuel injection orifice 220 is enhanced. Thereby, rectilinearity of the fuel having flowed into the fuel injection orifice is improved, so the spray angle can be made narrow.

Figure 15:
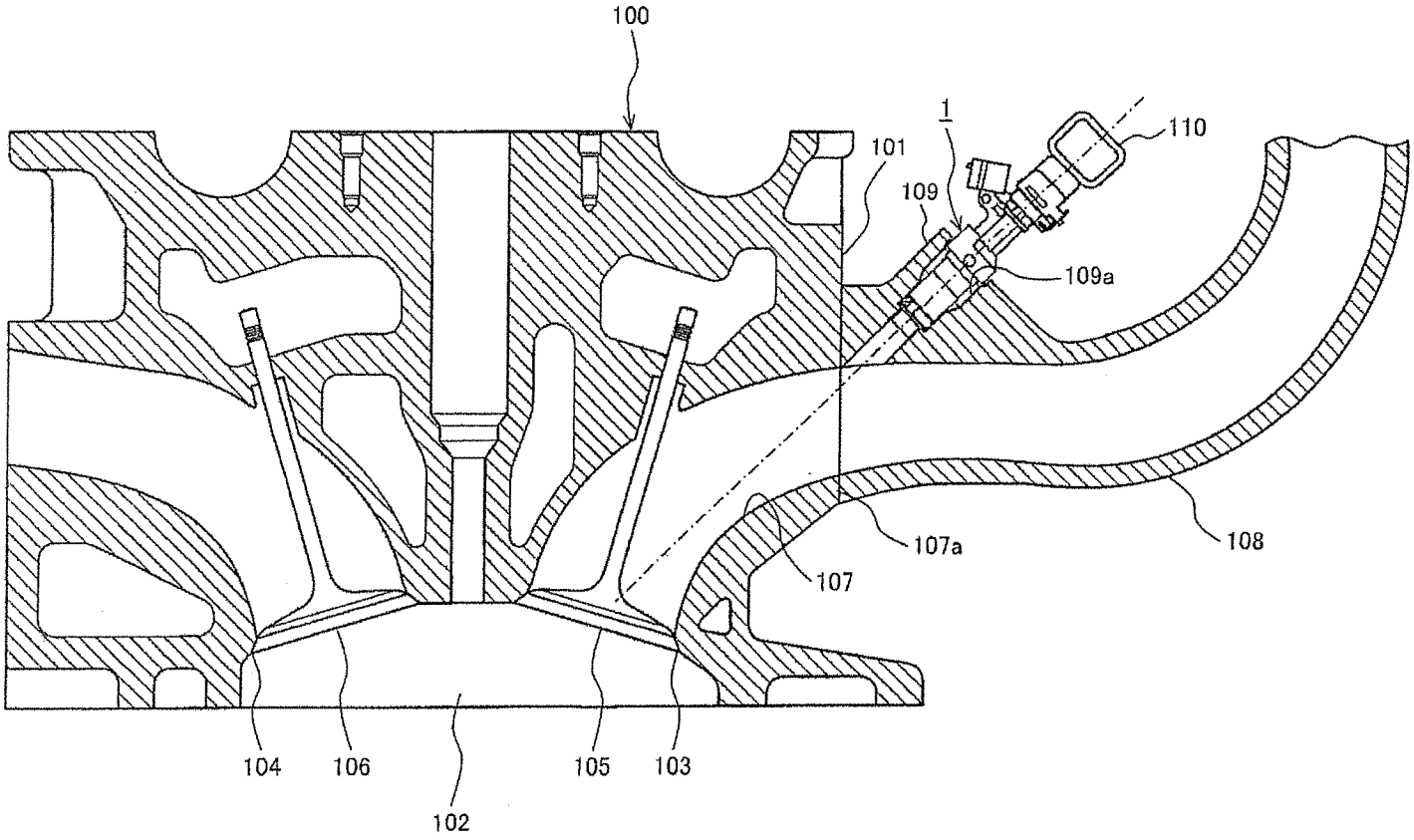
FIG. 15 is a cross section of an internal combustion engine in which the fuel injection valve is mounted.

The internal combustion engine in which the fuel injection valve of the present invention is mounted will be explained with reference to FIG. 15. FIG. 15 is a cross section of the internal combustion engine in which the fuel injection valve 1 is mounted.

A cylinder 102 is formed in an engine block 101 of an internal combustion engine 100, and an intake port 103 and an exhaust port 104 are provided at a top of the cylinder 102. The intake port 103 is provided with an intake valve 105 that opens/closes the intake port 103. The exhaust port 104 is provided with an exhaust valve 106 that opens/closes the exhaust port 104. An intake pipe 108 is connected to an entry side end portion 107*a* of an intake passage 107 that is formed at the engine block 101 and communicates with the intake port 103.

A fuel pipe 110 is connected to the fuel supply port 2 (see FIG. 1) of the fuel injection valve 1.

A fixing portion 109 for the fuel injection valve 1 is formed at the intake pipe 108, and the fixing portion 109 is provided with an insertion port 109*a* into which the fuel injection valve 1 is inserted. The insertion port 109*a* penetrates the intake pipe 108 up to an inner wall surface (intake passage) of the intake pipe 108, and the fuel jetted from the fuel injection valve 1 inserted in the insertion port 109*a* is jetted into the intake passage. In a case of two-direction spray, a target is an internal combustion engine having a form where two intake ports 103 are provided at the engine block 101, and the fuel sprays are injected toward each intake port 103 (each intake valve 105).

The present invention is not limited to the above embodiment or modification example although having been explained above on the basis of them. Therefore, a part of the configuration could be removed, or another element that is not disclosed in the above embodiment or modification example could be added. Furthermore, in the embodiment and the modification example, the element that is disclosed in the above embodiment or modification example can be changed or added.

The invention claimed is:

1. A fuel injection valve comprising:

a valve body;

a fuel injection orifice provided in a downstream side of a valve seat which the valve body is structured to move toward and away from;

a swirl chamber having a bottom surface on which an entry opening of the fuel injection orifice is configured to open and an inner circumferential wall surrounding the bottom surface, the swirl chamber having:

a swirl passage for fuel, the swirl passage formed between the inner circumferential wall and the entry opening; and a transverse passage whose downstream end is opened in the inner circumferential wall of the swirl chamber in order to provide the fuel into the swirl chamber, the transverse passage having:

one side wall connected to an upstream side of the inner circumferential wall in a flow direction of swirling fuel; and another side wall connected to a downstream side of the inner circumferential wall in the flow direction of the swirling fuel, and wherein an extension line formed by extending the another side wall of the transverse passage to a swirl chamber side, and a straight line segment passing a center of the swirl chamber and being perpendicular to the extension line are arranged such that a center of the entry opening of the fuel injection orifice is shifted from the center of the swirl chamber along the extension line, and in two areas formed by dividing the swirl chamber into two with the straight line segment, the center of the entry opening of the fuel injection orifice is arranged in an area opposite to an area to which the transverse passage is connected.

2. The fuel injection valve as claimed in claim 1, wherein:

a first line segment passing the center of the entry opening and parallel to the extension line intersects with an opening edge of the entry opening at two points.

3. The fuel injection valve as claimed in claim 2, wherein:

a first flow passage width and a second flow passage width are formed at respective sides of the entry opening on the first line segment, and the first flow passage width, which is at the upstream side in the flow direction of the swirling fuel, is smaller than the second flow passage width, which is at the downstream side in the flow direction of the swirling fuel.

4. The fuel injection valve as claimed in claim 3, wherein:

the inner circumferential wall of the swirl chamber has an arc surface having a constant radius.

5. The fuel injection valve as claimed in claim 4, wherein:

the center of the swirl chamber is on the first line segment, and the first line segment corresponds with the extension line.

6. The fuel injection valve as claimed in claim 2, wherein:

the inner circumferential wall of the swirl chamber is formed with a spiral curve or an involute curve.

* * * * *